United States Patent [19]

Christy

[11] 4,011,033

[45] Mar. 8, 1977

[54] POSITIVE DISPLACEMENT VANE TYPE ROTARY PUMP

[76] Inventor: Charles A. Christy, 201 Airport Drive, No. 34, Farmington, N. Mex. 87401

[22] Filed: Apr. 2, 1975

[21] Appl. No.: 564,288

[52] U.S. Cl. ..... 418/253

[51] Int. Cl.[2] ..... F01C 1/00

[58] Field of Search ..... 418/137, 138, 189, 91, 418/241, 253, 255

[56] References Cited

UNITED STATES PATENTS

| | | | |
|---|---|---|---|
| 1,401,336 | 12/1921 | Johnson | 418/137 |
| 1,736,105 | 11/1929 | Washington | 418/138 |
| 2,233,269 | 2/1941 | Napolitano | 418/138 |
| 2,512,593 | 6/1950 | Brown | 418/241 |
| 2,796,837 | 6/1957 | Hunziker | 418/255 |
| 3,213,803 | 10/1965 | Meyer | 418/255 |

FOREIGN PATENTS OR APPLICATIONS

| | | | |
|---|---|---|---|
| 396,070 | 1/1908 | France | 418/137 |
| 120,674 | 1/1948 | Sweden | 418/137 |

*Primary Examiner*—C. J. Husar
*Attorney, Agent, or Firm*—Karl W. Flocks

[57] ABSTRACT

Vane type rotary pumping device comprising a stationary housing member having a cavity extending therethrough, a rotor disposed in the cavity for rotation therein and having a plurality of radial openings therein, and vane members extending in each of the openings for sliding movement therein and rotary movement along with the rotor. An inlet passage and an outlet passage formed on spaced apart portions of the housing member communicate with the cavity. The cavity includes a first cylindrical channel extending from the inlet passage to the outlet passage to serve as a fluid pumping chamber. The vane members extend radially outwardly of the rotor and in substantial pressure sealing relationship with the channel but maintaining a slight clearance therebetween while being rotated through the channel by the rotor to pump fluid from the inlet passage to the outlet passage. The cavity also includes a second cylindrical portion between the outlet passage and the inlet passage over which the rotor passes with the vane members retracted within the rotor. A circumferential groove extending in the second cylindrical portion provides communication between radial openings simultaneously passing the second cylindrical portion to relieve pressure therein and to thereby facilitate radial movement of the vane members.

6 Claims, 5 Drawing Figures

POSITIVE DISPLACEMENT VANE TYPE ROTARY PUMP

BACKGROUND OF THE INVENTION

This invention relates to improvements in vane type rotary devices, particularly adapted for use as a fluid pump.

SUMMARY OF THE INVENTION

In accordance with the present invention, improvements are provided in a vane type rotary device particularly adapted for use as a fluid pump comprising the advantages of enhanced stability and high efficiency at both high and low speed operation, reduced frictional wear and improved operational life expectancy. More particularly, in accordance with the present invention, a vane type rotary pump is provided which comprises a stationary housing having a cavity extending therethrough with an inlet passage, an outlet passage, a first cylindrical channel portion forming a fluid pumping chamber between the inlet and outlet passages, a second cylindrical portion constituting a non-pumping zone, and a vane-rotor assembly rotatably supported in the cavity of the housing for effecting pumping action. The vane-rotor assembly includes a rotor member which is adapted to rotate about an axis coaxial with the non-pumping zone of the cavity. The first cylindrical portion forming the pumping channel and the second cylindrical portion of the cavity are of equal radius, but having different centers. To effect pumping action the rotor is formed with a plurality of radial openings in which are disposed a plurality of vanes adapted to slide therein and rotate therewith. The sliding vanes are pivotally supported on a journal parallel to, but eccentric to the axis of the rotor so that rotation of the rotor induces radial movement of the vanes in the respective openings in the rotor. The eccentricity between the axis of the journal pivotally supporting the vanes and the axis of the rotor is arranged so that the vanes are moved out of their openings into sealing contact with the channel of the pump housing cavity to effect positive pumping action.

During movement of the rotor through the idle or non-pumping zone the vanes are radially retracted within their respective openings by reason of the eccentricity between the axes of the journal and of the rotor. In this connection the vanes must retract into their respective openings upon passing the outlet passage, and further retraction of the vanes ordinarily would in effect result in the drawing of a vacuum, which would be very difficult, if not impossible. To offset this difficulty or impossibility, a pressure relief groove is provided in the cavity in the area where the vanes are not pumping to provide communication between rotor openings simultaneously passing thereover, so that any fluid trapped in these openings may freely move therebetween particularly where one vane is moving radially inwardly and another vane is moving radially outwardly. Because of the pressure relief provided at the start of the idle phase of the rotor as each vane is retracted into the rotor, rotation of the rotor is enhanced by the inherent suction provided by the retracting vane.

BRIEF DESCRIPTION OF THE DRAWINGS

For better understanding of the present invention, reference may be made to the accompanying drawings in which.

DETAILED DESCRIPTION OF THE INVENTION

Figure 1:
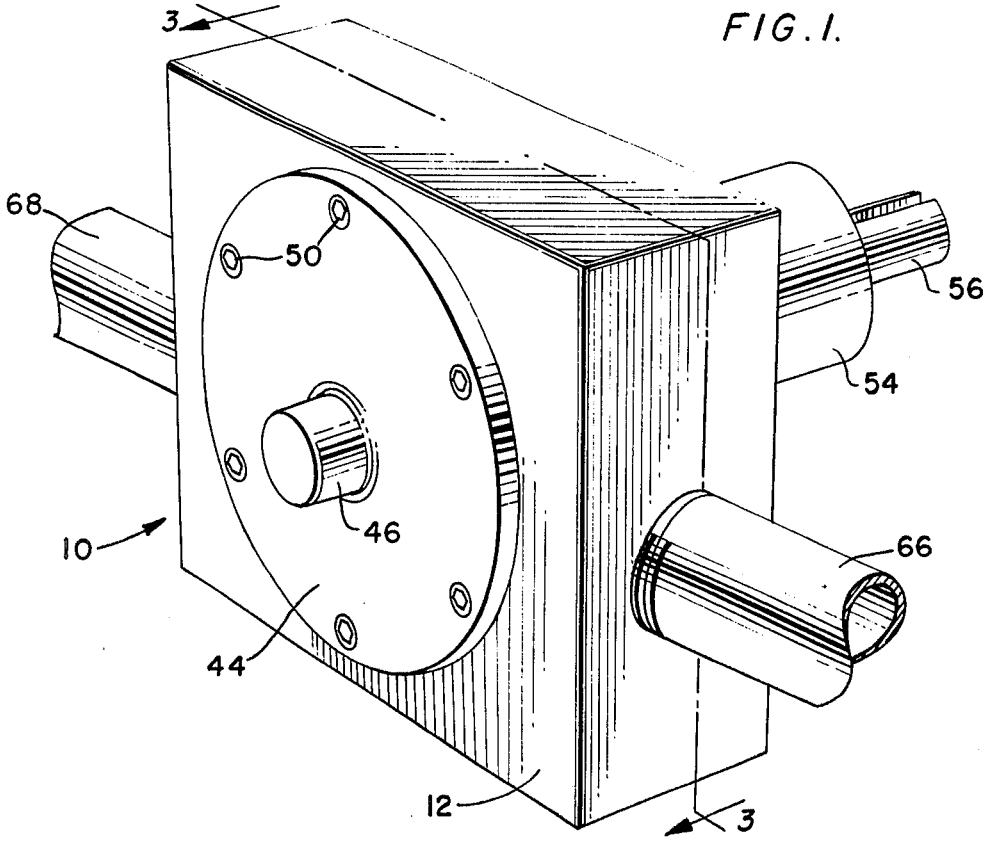
FIG. 1 represents an elevational view in perspective of the present invention.
Figure 2:
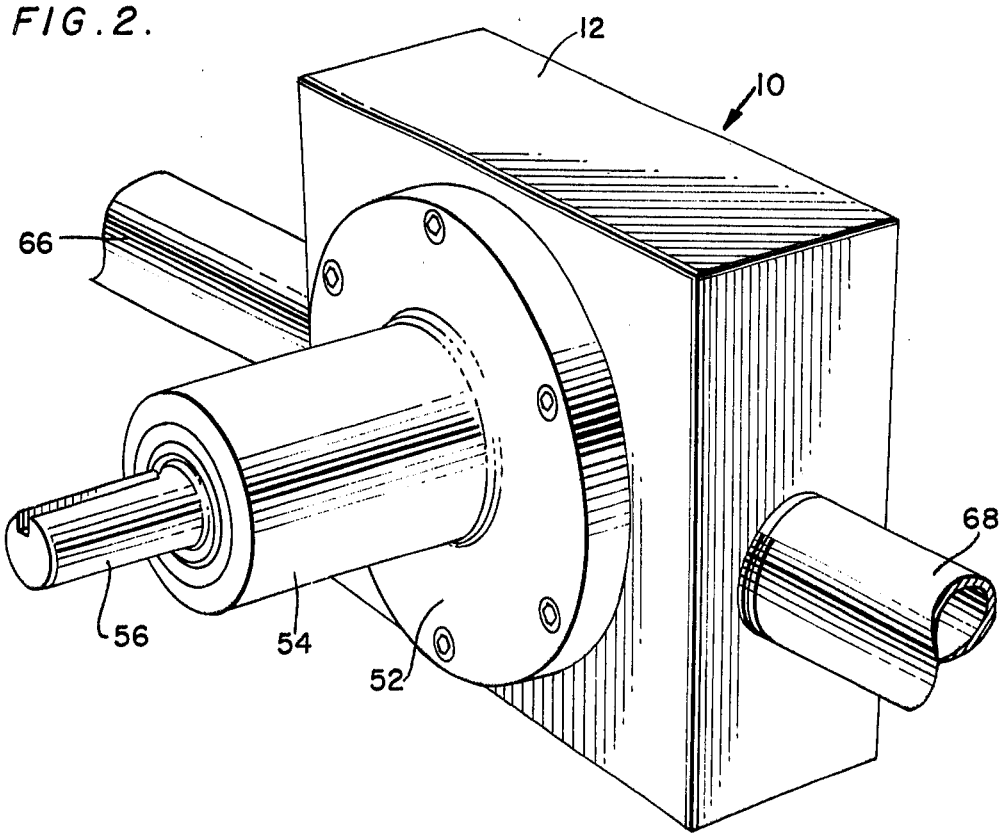
FIG. 2 is an elevational view in perspective of the invention in FIG. 1 looking in the opposite direction.
Figure 4:
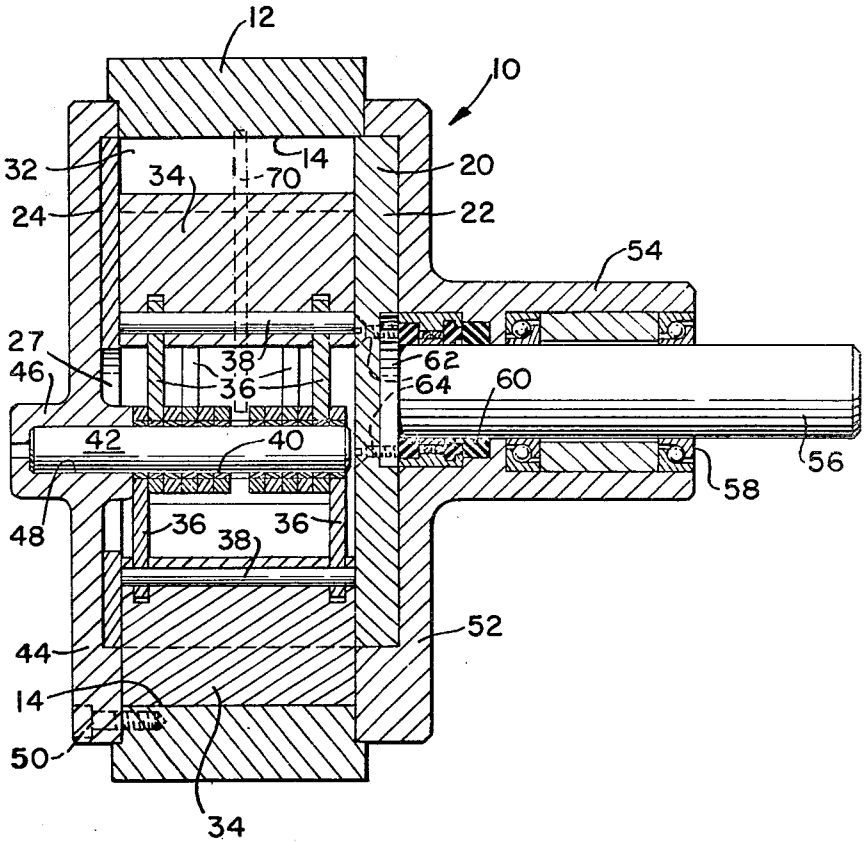
FIG. 4 is an elevational view in section taken along the line 4—4 and looking in the direction of the arrows in FIG. 3.
Figure 3:
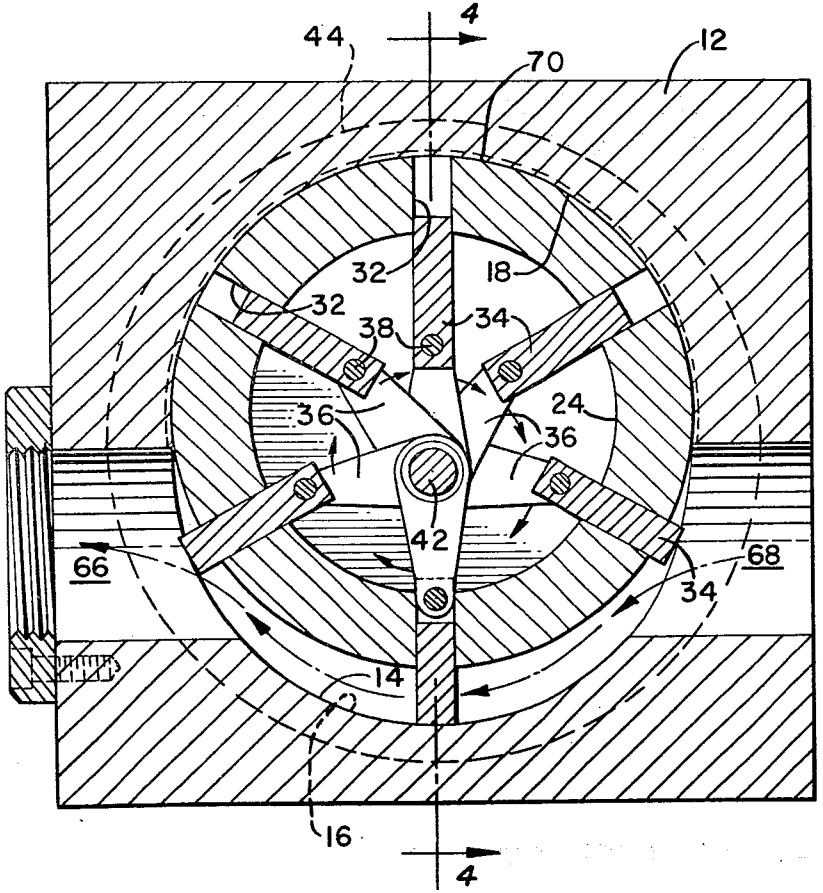
FIG. 3 is an elevational view in section taken along the line 3—3 in FIG. 1.
Figure 5:
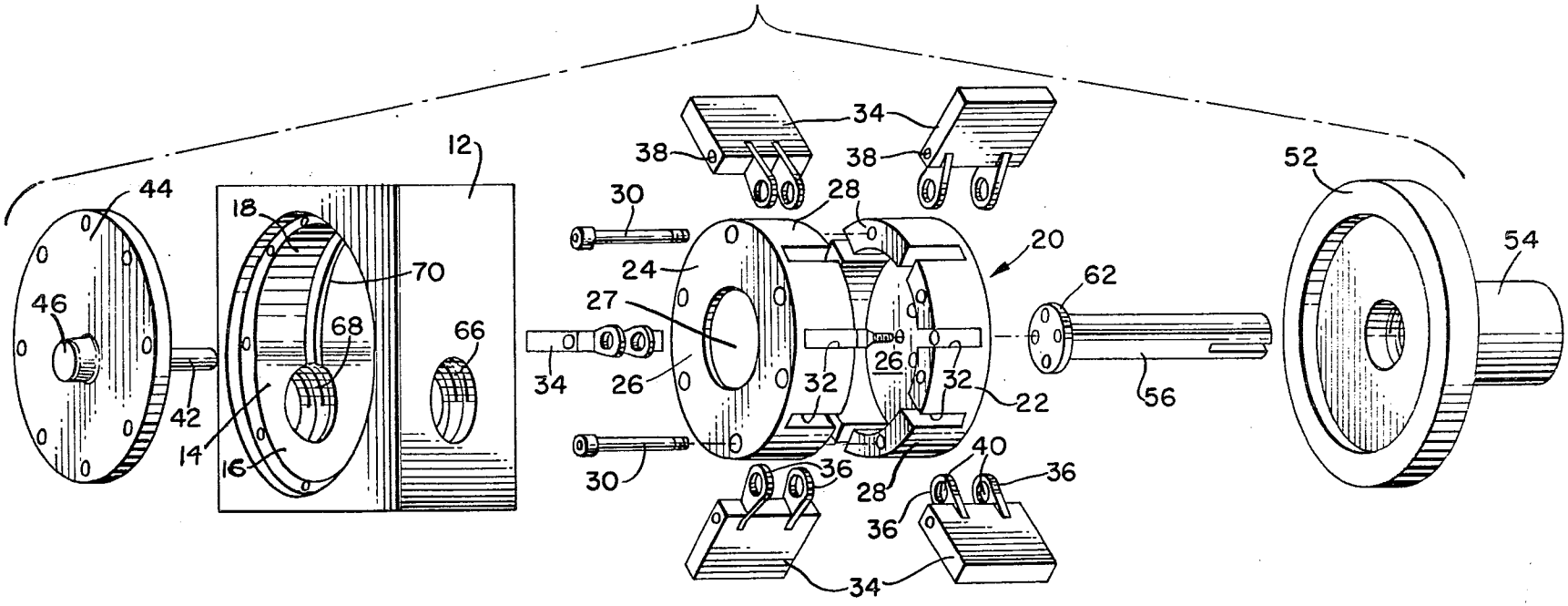
FIG. 5 is an exploded view in perspective of the invention of FIGS. 1–4.

Looking now in detail at FIGS. 1–5, it is seen that according to a preferred embodiment of the vane rotary device 10 according to the present invention comprises a housing member 12 with a cavity 14 extending therethrough, a rotor 20 disposed in the cavity 14 and end closure members 44, 52 bolted to rotor 12 as by bolts 50. Cavity 14 is formed from a pair of generally cylindrical portions 16, 18 having different centers but of equal radii of curvature. Housing member 12 is also formed with an inlet passage 68 which communicates with cylindrical channel portion 16 at one side thereof and an outlet passage 66 which communicates with the other side thereof. Cavity 14 is further provided with a circumferentially extending groove 70, as clearly seen in FIGS. 3 and 5, the function of which will be further described hereinbelow. Rotor 20, which may for convenience be made in two separate half-shell parts 22, 24 bolted together by screws 30, comprises a plurality of radial slots or openings 32 and radial flanges 26 on axial ends thereof. Also, for convenience, rotor 20 may be generally cylindrical in shape and provided with an enlarged aperture 27 in flange 26 of half-shell part 24, as seen in FIGS. 2 and 4. Rotor 20, as seen in FIG. 4, is rigidly connected to the flange 62 of drive shaft 56 by screws 64 passing through part 22 thereof. Rotor 20 is formed with a plurality of radial slots or openings 32 between axially extending portions 28 of member 20. Radially extending blades 34 are disposed in each openings 32 for sliding movement therein and rotary movement therewith. The blades 34, which have connecting links 36 held thereon by pins 38 are constrained to rotate along with rotor 20 by the openings 32 and forced to slide therein since the blades are pivotally connected by at least one radially inwardly connecting link 36 with an opening 40 around a journal element 42 fixed end closure member 44 which is eccentric to the axis of rotation of the shaft 56. In addition to being in pivotal relationship with journal element 42, each connecting link 36 is in pivotal relationship with the blade 34 associated therewith at the connection by pin 38 as may be seen in FIG. 3 which shows different angular relationships between blades 34 and connecting links 36 in various positions thereof. Connecting link 36 of each blade 34, as clearly seen in FIG. 4, is axially offset from each other and pivotally connected to journal element 42 extending inwardly from bore 48 of sleeve 46 on end closure member 44 in cantilever fashion and eccentric to the rotor 20. Journal element 42, which thus extends parallel to but eccentrically of drive shaft 56 and through and clear of enlarged aperture 27, by reason of its eccentricity relative to shaft 56 causes blades 34 to slide in openings 32.

In operation of the vane rotary device 10, power transmission means (not shown) on the end of drive shaft 56 supported on bearing assembly 58 in axial sleeve 54 of closure member 52 effects rotation of rotor 20 whereby blades 34 are caused to move past inlet passage 68 and through channel 14 which forms a pumping chamber to pump fluid to outlet passage 66. In thus being driven clockwise, as indicated by the arrows in FIG. 3, blades 34 are caused to slide outwardly of radial openings 32 of rotor 20 by reason that journal element 42 is eccentric to drive shaft 56 in the direction toward channel 16 whereby the radial outer edges of blades 34 are constrained to effect fluid pumping action in channel 16, but yet maintaining a clearance therewith while in pumping relationship therethrough. After the blades 34 pass the outlet passage 66, they are retracted radially inwardly of rotor 20 by reason of the eccentricity between journal element 42 and shaft 56, and in so being retracted difficulty may be expected to be encountered due to the virtual impossibility to draw a vacuum. To offset this difficulty circumferential groove 70 permits communication between radial openings 32 simultaneously moving through an idle phase of the operation so that pressure whether negative or positive in these openings 32 may be relieved therebetween. While the radial outer edges of the blades 34 are in pumping relationship with channel 16, they are maintained at a clearance of about 0.002 inches which clearance will avoid wear between moving parts and ensure long operating life. Moreover, the radial outer edges of blades 34 are rounded so as to be substantially concentric with the channel 16 while effecting pumping therethrough.

Seal assembly 60 is provided in the axial sleeve 54 to ensure against leakage.

It will be obvious to those skilled in the art that various changes may be made without departing from the scope of the invention and the invention is not to be considered limited to what is shown in the drawings and described in the specification.

What is claimed is:

1. A vane rotary device comprising a housing member having a cavity extending therethrough, said cavity including two cylindrical portions having spaced-apart centers but having substantially equal radii of curvature, first and second end closure members, a rotor disposed in said cavity and rotatably supported in said housing member for rotation about an axis coaxial with the center of a first one of said two cylindrical portions, said rotor having a plurality of radial openings therein, vane means disposed in each of said radial openings for sliding movement therein and rotary movement along with said rotor, an inlet passage and an outlet passage in said housing member communicating with said cavity, said inlet passage being separated from said outlet passage by said first and second cylindrical portions, a second cylindrical portion of said cavity forming a circumferential channel extending from said inlet passage to said outlet passage, said channel in operation of said pump serving as a fluid pumping chamber, said vane means extending radially outwardly of said rotor and in substantial pressure sealing relationship with said channel but maintaining a slight clearance therebetween while being rotated through said channel by said rotor thereby pumping fluid from said inlet passage to said outlet passage, said first cylindrical portion of said cavity constituting a non-pumping circumferential portion between said outlet passage and said inlet passage over which said rotor passes with said vane means retracted within said rotor and a circumferential groove extending in said first cylindrical portion to provide communication only between radial openings simultaneously passing said first cylindrical portion to relieve pressure therein and thereby to facilitate radial movement of said vane means, and said vane means comprise a plurality of sliding blade members each of which is supported on a fixed journal element for pivotal movement about an axis parallel to but eccentric to the axis of rotation of said rotor by at least one radially inwardly extending connecting link pivotally connected to said journal element and to said blade member.

2. The device as claimed in claim 1, wherein said rotor includes radial flanges on opposite sides thereof which maintain opposite sides of each of said sliding blades out of contact with said first and second end closure members.

3. The device as claimed in claim 2, wherein said journal element extends inwardly from one of said end closure members in cantilever fashion.

4. The device as claimed in claim 3, wherein the radial outer edge of each of said blade members is rounded so as to be generally cylindrical and maintained at a slight clearance from said channel at about 0.002 of an inch.

5. The device as claimed in claim 4, wherein said rotor comprises two cup-shaped halves bolted together.

6. The device as claimed in claim 3, wherein each of said blade members includes at least two radially inwardly extending connecting link portions pivotally connected to said journal element and all of said connecting link portions are axially offset from each other along the length of said journal element.

* * * * *